United States Patent [19]

Kranz

[11] Patent Number: 4,927,096

[45] Date of Patent: May 22, 1990

[54] ROTOR SETTING SYSTEM IN CONJUNCTION WITH AERODYNAMIC BODY CONTROLS

[75] Inventor: Walter Kranz, Taufkirchen, Fed. Rep. of Germany

[73] Assignee: Messerschmitt-Bölkow-Blohm GmbH, München, Fed. Rep. of Germany

[21] Appl. No.: 16,881

[22] Filed: Feb. 20, 1987

[30] Foreign Application Priority Data

Feb. 27, 1986 [DE] Fed. Rep. of Germany ..... 3606423

[51] Int. Cl.[5] ..... F42B 15/027; F41G 9/02

[52] U.S. Cl. ..... 244/3.22

[58] Field of Search ..... 244/3.21, 3.22

[56] References Cited

U.S. PATENT DOCUMENTS

| | | | |
|---|---|---|---|
| 3,102,437 | 9/1963 | Geyer | 244/3.21 |
| 4,210,298 | 7/1980 | Liberman | 244/3.21 |
| 4,438,893 | 3/1984 | Sands et al. | 244/3.21 |

*Primary Examiner*—Charles T. Jordan
*Assistant Examiner*—Richard W. Wendtland
*Attorney, Agent, or Firm*—Kenyon & Kenyon

[57] ABSTRACT

A rotor setting system in conjunction with an aerodynamic-body control. The setting system is characterized by a rotor which comprises a console, a rotary drive for the rotor, setting members for the control of the aerodynamic body, especially rudders or spoilers, as well as a control unit for the rotor, and further including a control unit on the sides of the aerodynamic body, wherein the two control units cooperate with each other for adjusting the setting members.

9 Claims, 10 Drawing Sheets

FIG. 6
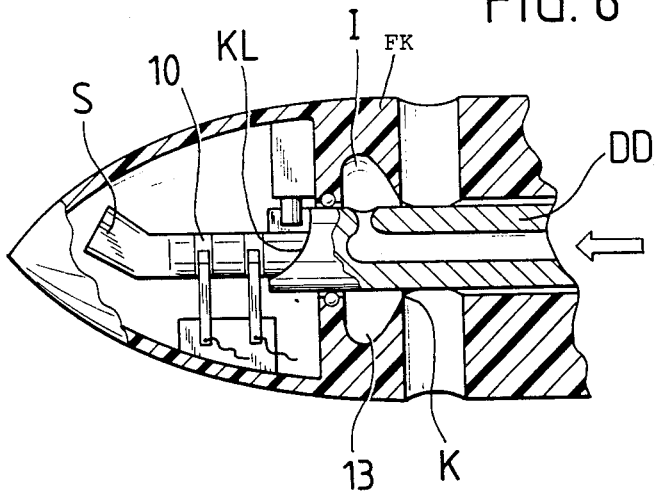
FIG. 7
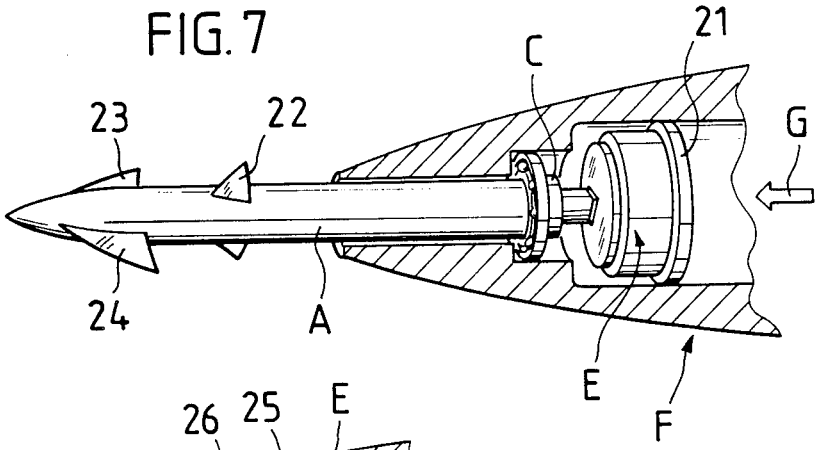
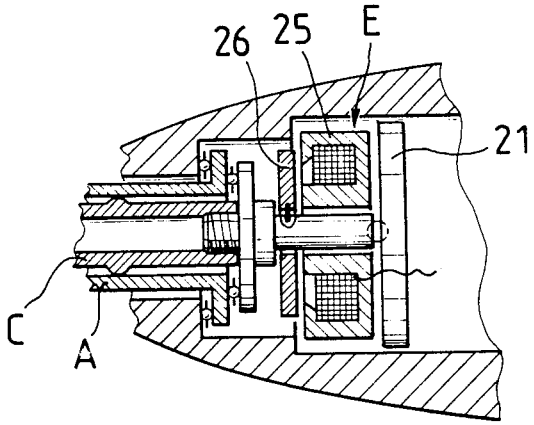
FIG. 8

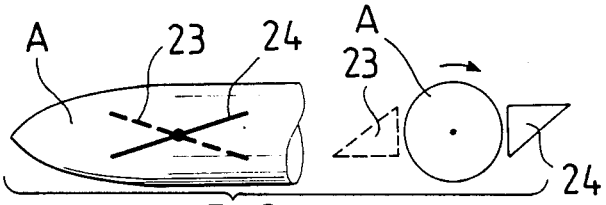
FIG. 9a
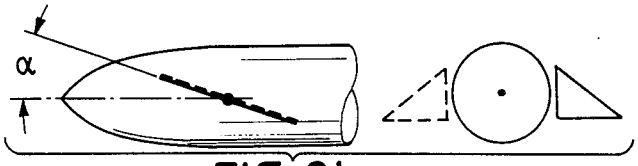
FIG. 9b
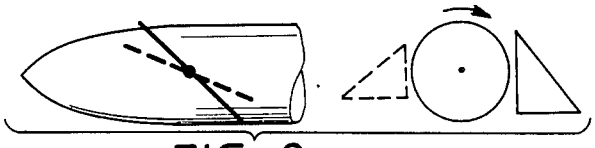
FIG. 9c
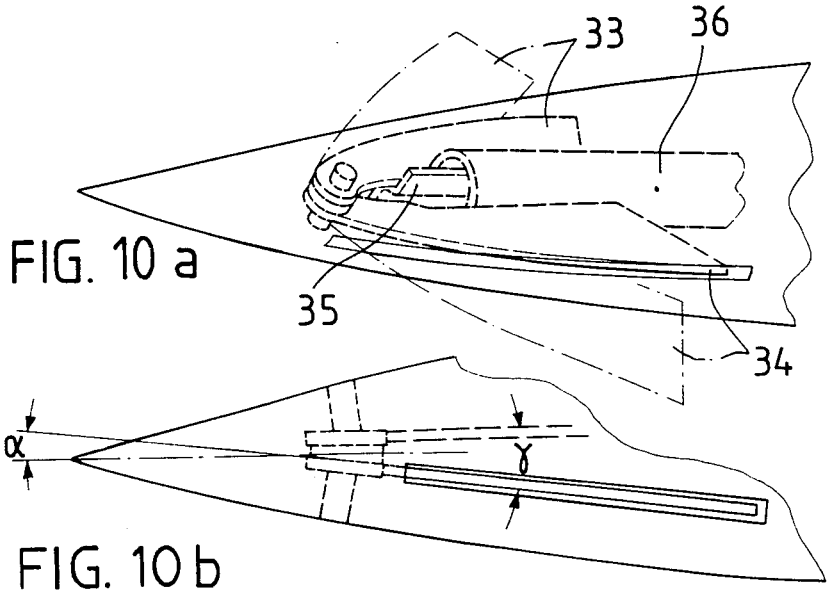
FIG. 10 a
FIG. 10 b FIG. 13a
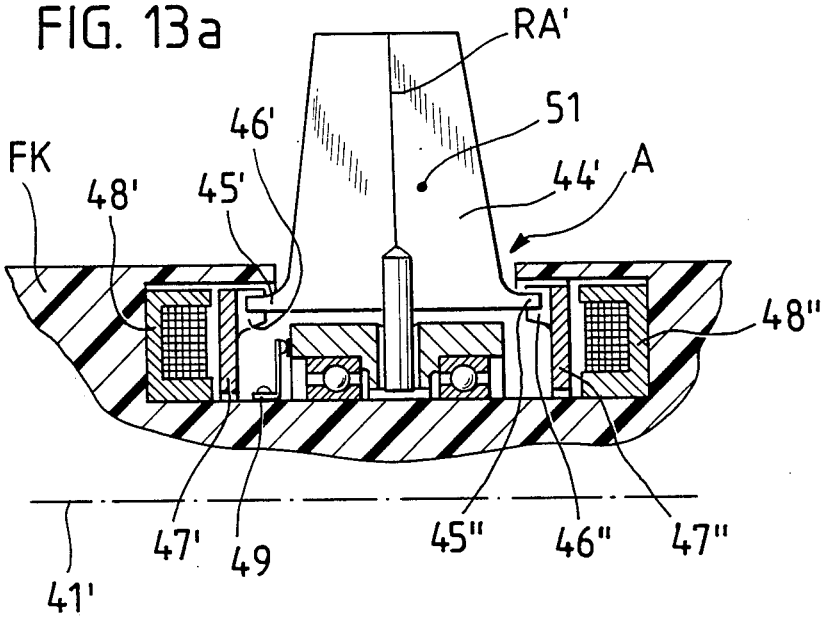
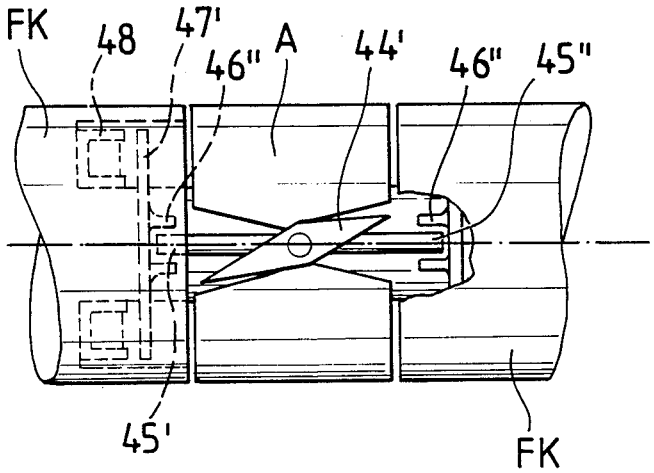
FIG.13b

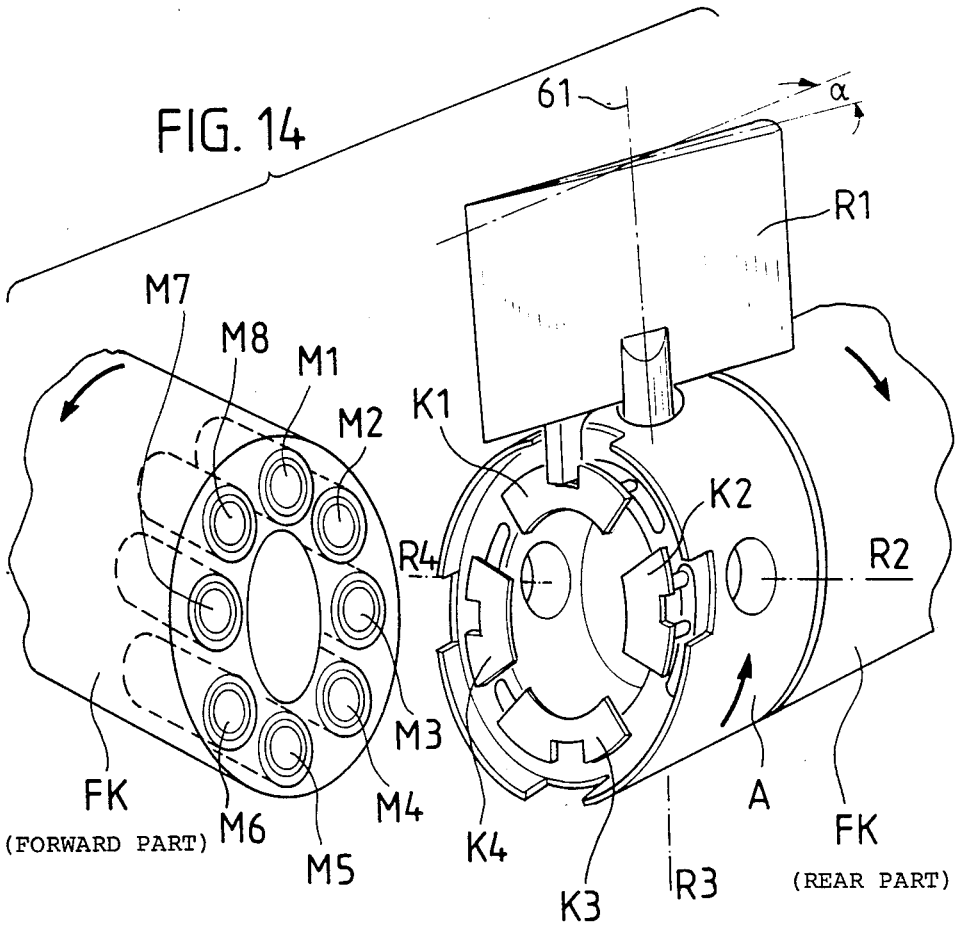
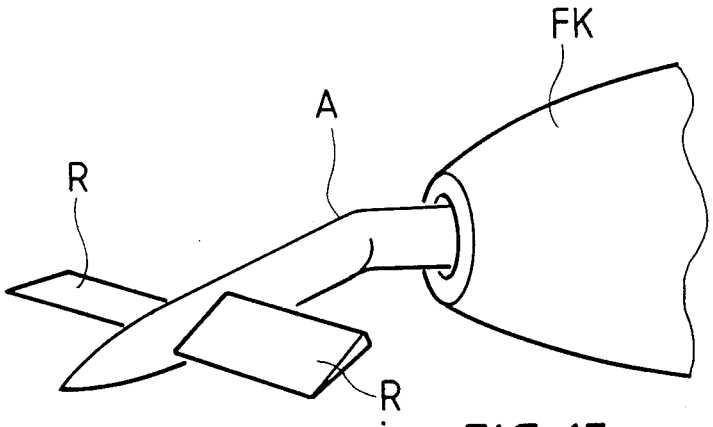
FIG. 15

ROTOR SETTING SYSTEM IN CONJUNCTION WITH AERODYNAMIC BODY CONTROLS

BACKGROUND OF THE INVENTION

The present invention relates to a rotor setting system for aerodynamic body systems.

SUMMARY OF THE INVENTION

It is an object of the present invention to provide a rotor setting system and in particular, a rudder system or spoiler system, by which an aerodynamic body can be controlled with a minimum of technical means. In particular, the rotor setting system provided should also be possible for controlling relatively small aerodynamic bodies, in which case low-inertia systems are proposed. For controlling slower and larger aerodynamic bodies such as free-fall bombs, effective rotor setting systems having inertia are to be described.

The above and other objects of the present invention are achieved by a rotor setting system for an aerodynamic body in combination with control means for the aerodynamic body, the system comprising rotor means comprising support means, rotary drive means for the rotor means, setting means for controlling the operation of the aerodynamic body, first control unit means for controlling the rotor means, and second control unit means disposed on the aerodynamic body cooperating with the first control unit means.

BRIEF DESCRIPTION OF THE DRAWINGS

The invention will be explained in greater detail in the following detailed description with reference to the drawings, in which:

FIG. 6 shows a cross section through a tip of an aerodynamic body with a driven searching head system;

FIG. 7 shows a cross section through the tip of an aerodynamic body with a rotor setting system according to the invention which comprises a rotary part which protrudes forward from the aerodynamic body and at the tip of which, two mutually offset and adjustable rudders are arranged, the rotary part being positionable by means of a braking system;

FIG. 8 shows the control unit with a braking system for the rotor setting system in FIG. 7;

FIG. 9 shows a schematic presentation of different commands which are possible with a rotor setting system according to FIG. 7, namely, a roll command for driving the rotary part with the pair of wings tilted in FIG. 9*a;* a pitch command in the direction of the angle alpha with wings set parallel in FIG. 9*b;* and a pitch command with wings adjusted in the same sense and one direction, but not adjusted by the same angle with simultaneous roll drive in FIG. 9*c;*

Figure 11:
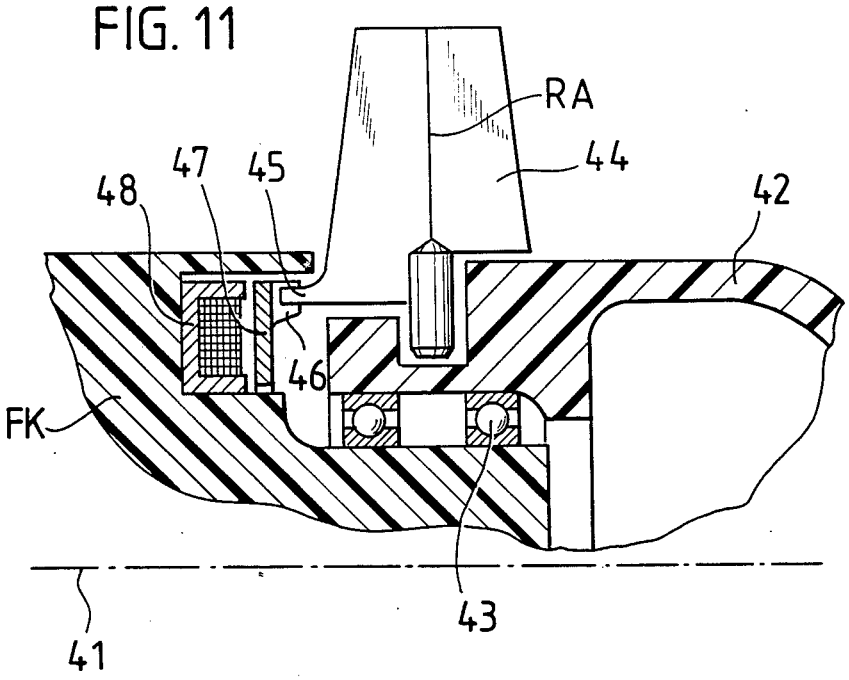
Figure 12:
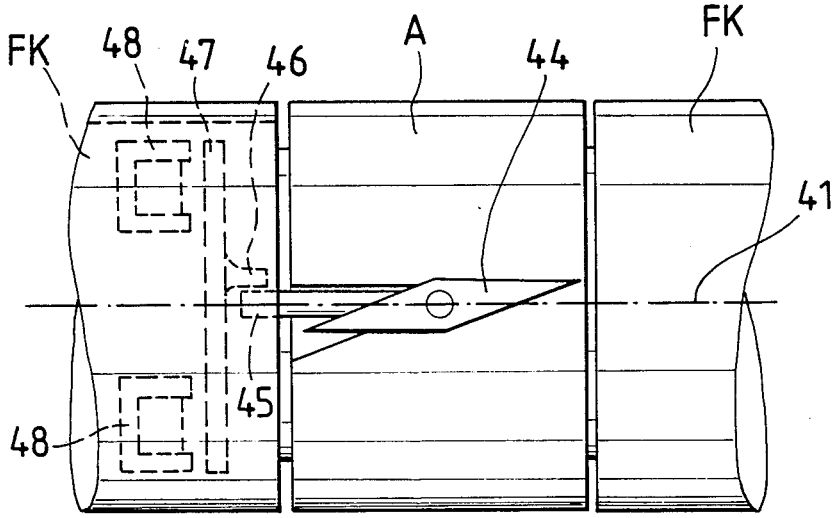
Figure 16A:
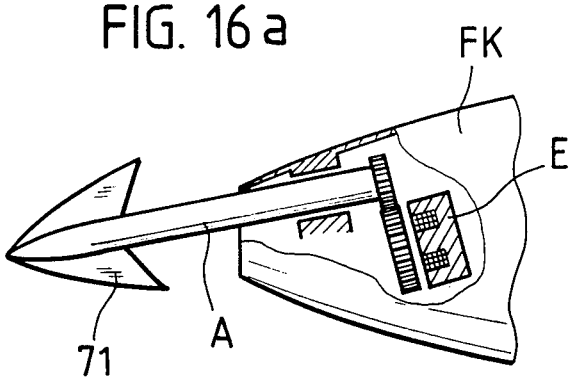
Figure 16B:
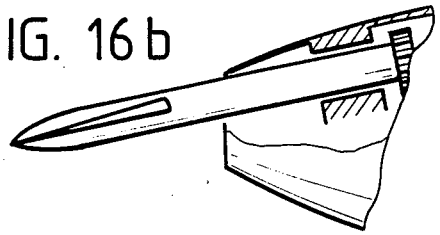
Figure 17:
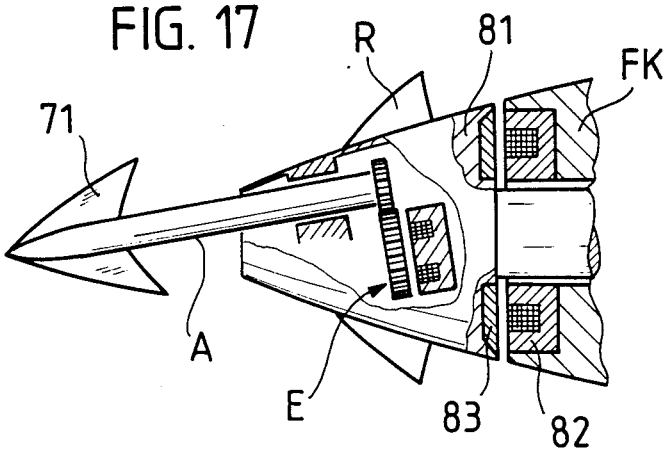
Figure 18A:
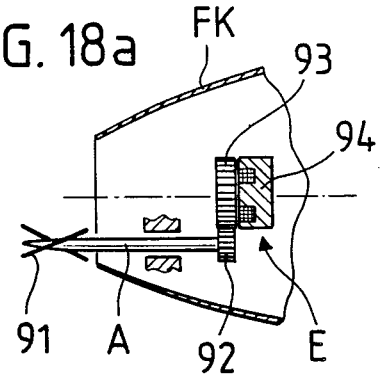
Figure 18B:
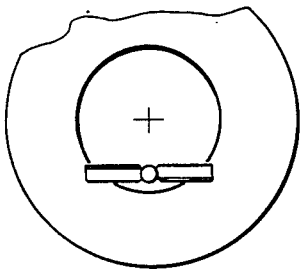
Figure 18C:
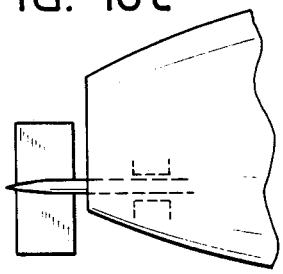
Figure 18D:
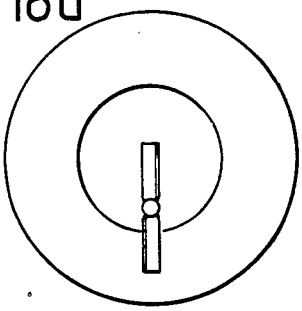
Figure 19A:
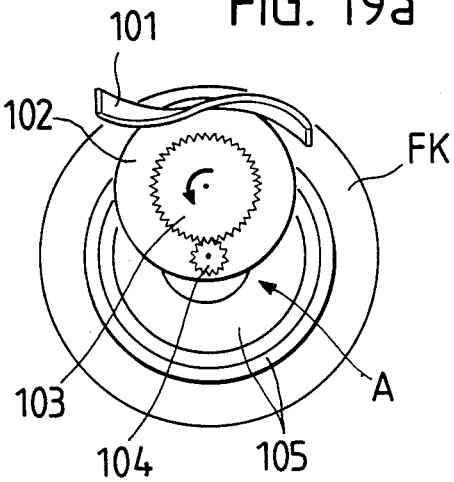
Figure 19B:
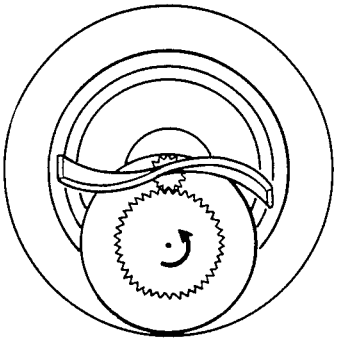

FIG. 10 shows the tip of a rotary part for a setting system similar to FIG. 7 with two staggered wings which can be swung into the inside contour of the rotary part and can be swung out of it for deriving a pitch command;

FIG. 11 shows a partial presentation of the forward part of an aerodynamic body equipped with a target searching head, where rudders corotate with the target searching head, which are tiltable about a radial axis of rotation and can be swung about the rudder axis by means of a magnetic braking system for generating a pitch command;

FIG. 12 shows a partial side view of the aerodynamic body shown slightly modified with the rudder deflected;

FIG. 13 shows a setting system according to FIG. 11 where, however, a further magnetic system is provided on the forward side of the rudders in order to bring the rudders, after a pulse-like adjustment, into the rest position by a further control pulse, for which purpose the pressure point of the rudder is located in front of the radial rudder axis as seen in the flight direction of the aerodynamic body;

FIG. 14 shows an exploded bent view of a forward part of an aerodynamic body and a rear part of an aerodynamic body with a multiple-rudder rotor system, where this rotor system supports several, in this case, four rudders on a rotary part;

FIG. 15 shows a schematic partial view of the forward part of an aerodynamic body with a bent-off rotary part, at the tip of which two opposite and mutually staggered fixed rudders are arranged which, for one, force a rotation of the rotary part and secondly, exert a transverse force if the rotary part is stopped relative to the aerodynamic body, substantially fixed in space;

FIG. 16 shows schematically, a cross section through the tip of an aerodynamic body with a straight rotary part which comprises at its forward tip two wings tilted relative to each other, this rotary part being inclined relative to the longitudinal axis of the aerodynamic body;

FIG. 17 shows a variant of the rotor system shown in FIG. 16, where the rotary part for the staggered (offset) pair of wings is arranged on a further rotary part which can be set in rotation by means of staggered rudders, which, on the other hand, can be deposited on the aerodynamic body and held in different positions relative to the latter;

FIG. 18 shows cross sections and front views, respectively, of a part of an aerodynamic body with a rotor-spoiler system, where two opposite spoilers arranged staggered relative to each other, are arranged in the vicinity of the aerodynamic body tip on a rotary part, the axis of rotation of which is parallel to the longitudinal axis of the aerodynamic body, where the position of the spoilers can be set by means of a magnetic brake system; in FIGS. 18*a* and 18*b,* the position of the rotary body and the spoilers for a full command is shown, in which the ram air impinges on the front surface of the aerodynamic body designed as an impact surface and is, on the other hand, conducted past the spoiler so that a pitch command is obtained; in FIGS. 18*c* and 18*d*, the position of the rotary part with the spoiler for a null command is shown where the flow about the aerodynamic body is relatively symmetrical and only the part protruding from the outside contour of the aerodynamic body of the spoiler offers low resistance; and FIG. 19 shows a top view onto a further rotor spoiler system, whereby the spoiler is arranged on a kind of planetary support with several gears rolling on each other and can be brought from a position near the circumference of the aerodynamic body shown in FIG. 19*a*into a position approximately in the middle of the aerodynamic body according to FIG. 19*b* for a null command, for obtaining a full command.

DETAILED DESCRIPTION

ROTOR SETTING SYSTEM I TO III

The rotor setting system is characterized by a console which can be rotated or tilted about the longitudinal axis of the aerodynamic body parallel or at an angle thereto, which supports the setting members for generating the transverse force. The actuation of the setting members is brought about by coupling them to the aerodynamic body in a controlled manner via a control mechanism. The direction of the transverse force is determined by the instantaneous angular position of the setting members relative to the environment during the coupling. The magnitude of the transverse force and the transverse pulse, respectively, are determined by the duration of the coupling.

The power for actuating the setting members is preferably taken normally from the rotary drive of the rotor.

The actuation of the setting members comes about by their controlled coupling to the aerodynamic body via the control mechanism, where a further rotor can be located between the aerodynamic body and the control mechanism (for instance, a rotation of the body for the functioning of different variants is then obviated). Additional drives are possible, for instance, by offsetting the rudders by means of a motor between the two rotors or by one rotor between the second rotor and the aerodynamic body.

Accordingly, the essential components of the rotor setting system are the following:

a rotor comprising the console, rotary drive for the rotor setting members and a control unit for the rotor;

the aerodynamic body with the control unit for the aerodynamic body.

Further details of the rotor are frequently combined in one part with multiple function.

As setting members, the following may be used:

aerodynamic or aquadynamic jet rudders, aerodynamic or aquadynamic jet spoilers, thrust nozzles dampers or the like.

The following can be considered for the rotary drive of the rotor:

offset aerodynamic, aquadynamic or jet spoilers (hot gas), drives between the aerodynamic body and the rotor such as electric motors, pneumatic or hydraulic systems, thrust nozzles generating torques, turbine systems, spring drives.

For differing systems, the measurement of the rotational position of individual parts is necessary in order to obtain the relationship to the electrical command in the aerodynamic body part. As a matter of principle, the possible measurement (by a potentiometer, magnetic or optical pickup) is not listed.

Figure 1:
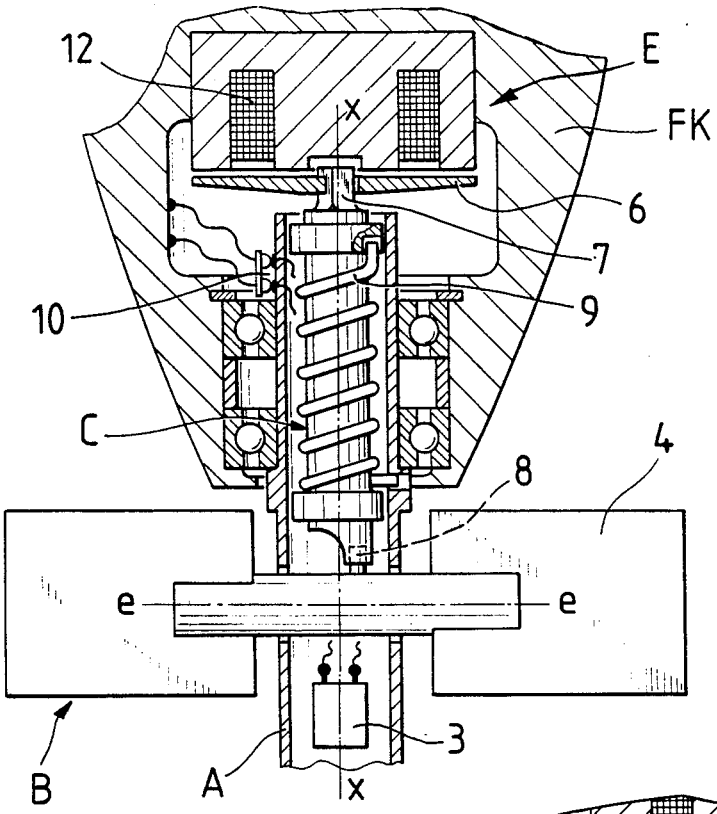
FIG. 1 shows a rotor setting system having a pair of rudders as the setting member, where the two rudders are equipped with a common shaft.
Figure 3:
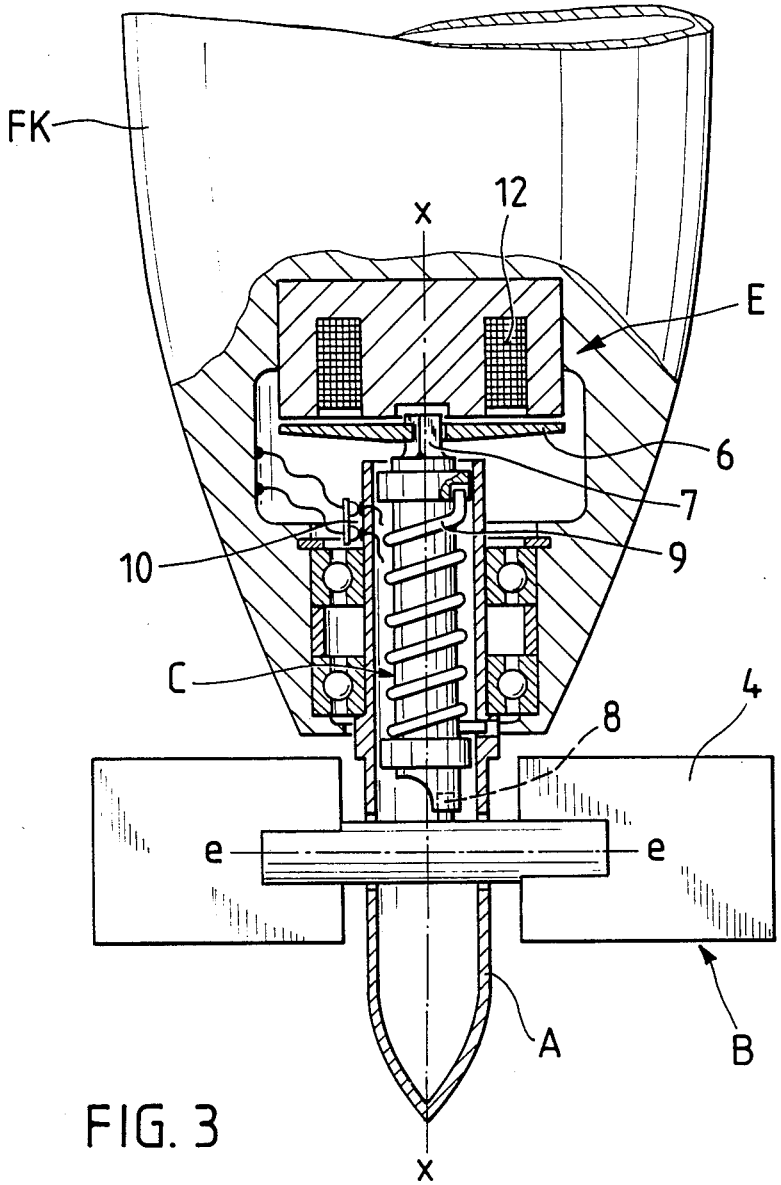
FIG. 3 shows a partially cross-sectional top view onto an aerodynamic body equipped with a setting system according to FIG. 1.

Description For FIG. 1 and FIG. 3

Rotor Setting System: Rotor-Rudder System I

Console: Part A with large inertia about the axis x—x.

Rotary Drive of the Rotor: The offset pair of rudders B.

Part B or an extra pair of rudders generates a roll torque. Setting Members: Offset Pair of Rudders B, rotatably supported about e—e, generates a transverse force if Part C is braked.

Control Unit - Rotor: Part C with lever transmission to Part B.

These parts form the rotor.

The control unit for the aerodynamic body FK is the braking system E.

Command Null: the braking system E is not activated. The rotor continues to run, driven, for instance, by an offset pair of rudders B.

Command Issue: the braking system is activated. Part C is braked relative to Part A and rotates in the process the pair of rudders B via the pin 8 so that a transverse force is generated.

Notes: A full command is possible every 360° into one direction in space. The rotor continues to run.

Figure 2:
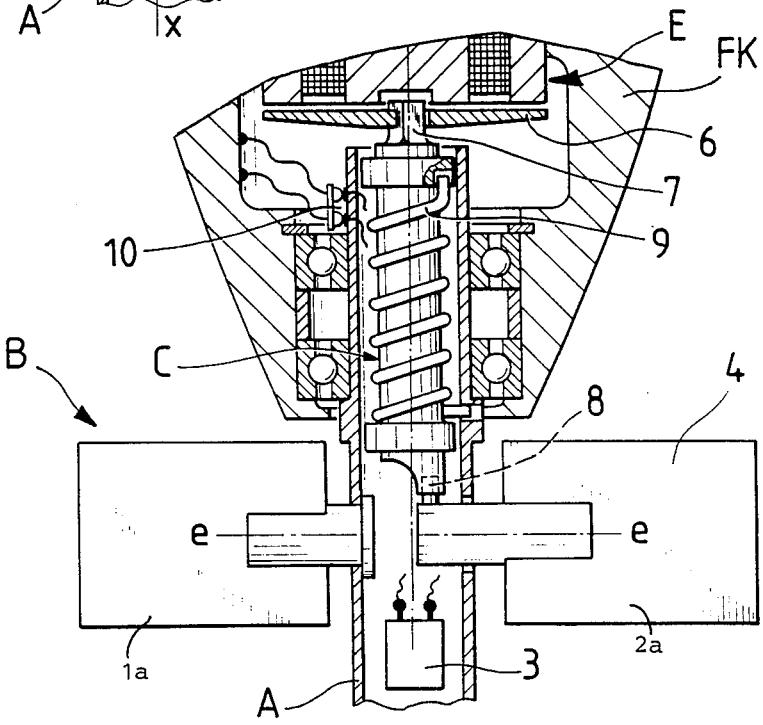
FIG. 2 shows a system similar to that of FIG. 1 wherein, however, one rudder is fixed and the other adjustable.

Description For FIG. 2

Rotor Setting System: Rotor-rudder system II Console: Part A with small inertia about the axis x—x; Rotary Drive of the Rotor: offset pair of rudders B; Setting Members: Rudder 2 (rudder 1*a* is firmly connected to Part A);

Control Unit Rotor: Part C

These parts form the rotor.

Control Unit: aerodynamic body FK: braking system E

Command Null: Braking system is not activated, rotor continues to run, driven by offset pair of rudders B.

Command Issue: braking system is activated: part C is braked relative to A and turns in the process the rudder 2*a* via the pin 8. The transverse force is generated by the pair of rudders in the average. The rotary drive is at the same time aided by the increased offset. The function is similar to the rotor setting system according to FIG. 1.

Figure 4:
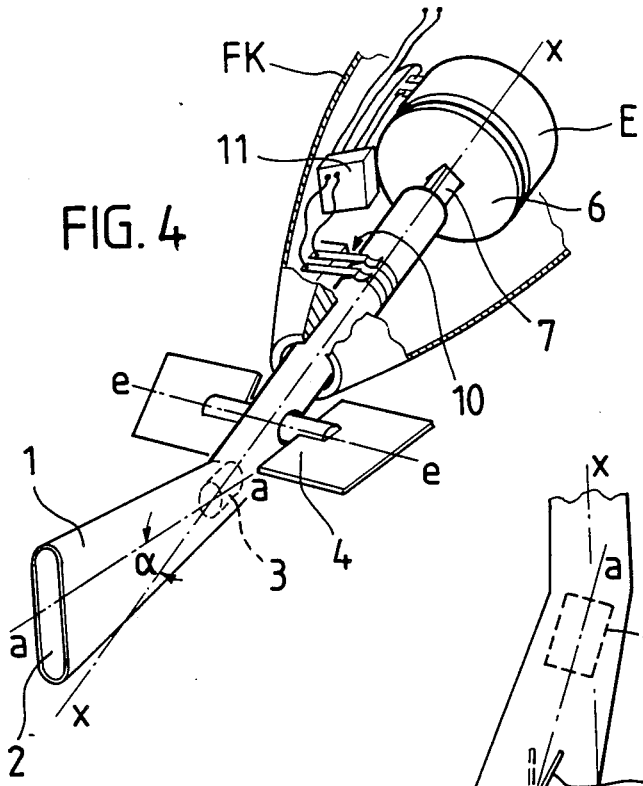
FIG. 4 shows a partially cross-sectional perspective view of the forward part of a setting system according to FIG. 1 or 2 which is combined with a searching head.
Figure 5:
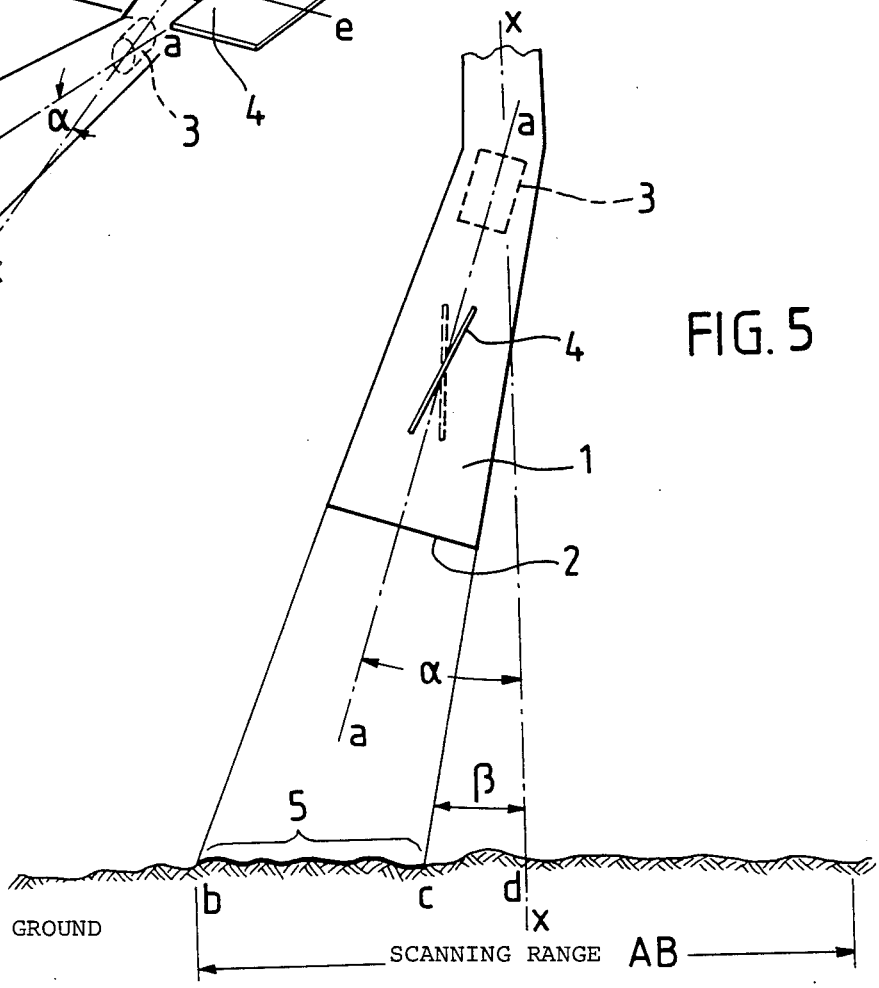
FIG. 5 is a schematic presentation of the principle for the searching head which in this case is equipped with a rotor setting system according to FIG. 15.

Search Head System (FIGS. 4 AND 5)

As an application of the Setting Systems according to FIG. 1 to 3 and FIG. 15.

Design: The Search Head System consists essentially of the aerodynamic body FK itself and a rotary unit A, consisting of an aerodynamic rotary drive with additional transverse-rudder action, and the sensor system 1, 2, 3 as well as a connecting member between the aerodynamic body and the rotary unit, a braking system E.

Operation: For operation, the following conditions are of importance:

the rotary unit rotates in a direction opposed to the direction of rotation of the aerodynamic body (about the x axis);

the aerodynamic body rotates about its x axis also relative to the environment.

The operation will first be explained by referring to a free-fall rocket, i.e., a relatively slow-flying aerodynamic body (FIGS. 4, 5). The sensor system consists of a funnel 1 with a slot-shaped opening 2 ("acoustic tube") and the acoustic sensor 3 itself, all of which rotate at an angle alpha to the x axis, caused by the offset pair of wings 4.

By the rotation, the sensor system scans the ground area 5 drawn with solid lines in FIG. 5, rotation-symmetrically with the width and length corresponding to the funnel slot 2 and in the process forms the maximum scanning range AB.

Command Null: (i.e., no target is detected):

The rotary unit rotates freely and unimpeded by the braking system due to the offset wing pair 4; the scanning range AB is reduced here with decreasing distance of the aerodynamic body from the ground.

In the case according to FIG. 5, a transverse force is generated depending on the rotational position of the axis a—a by the pair of wings, the effect of which is at least cancelled by rotation to the extent that in the average the aerodynamic body retains the direction of flight.

In the case according to FIG. 4, the rotary drive is on the axis x—x (or parallel thereto), so that no transverse forces can become effective on the aerodynamic body FK: (reduction of resistance, simplification of the control, however, at the expense of the increased amount of means for generating the transverse force in the case of a command; description of the operation will follow).

Operation If Target is Detected:

If a target is located within the scanning range AB on the annular ground area, formed by the rotation of the rotary unit and the ring thickness b—c which gives off noise, the sensor picks up these noises and immediately initiates the braking process "rotary drive versus aerodynamic body."

Since the rotary drive has a low mass inertia relative to the aerodynamic body, the rotary unit now corotates with the aerodynamic body if the braking is complete or already if the braking is reduced, i.e., against its original direction of rotation and also opposite in space to the target, since the aerodynamic body itself rotates relative to the environment.

Thereby, the sensor again loses the acoustic signal, i.e., the target; the brake is disengaged and the rotary drive rotates again into its original direction until the acoustic signal is picked up again and the brake is switched on again. This process is repeated continuously. In the average the rotary unit is located here fixed in space with the axis a—a in the direction of the target, i.e., the pair of wings 4 (FIG. 1, 4) generates continuously a transverse force in the aerodynamic body in the direction of the target and specifically, until the acoustic signal is within the cone angle beta. The result is the command null.

Because of the increasing reduction of the distance between the aerodynamic body and the target, the signal, however, appears again and again in the range between b and c from "inside" (c—e); an accordingly pointing transverse force is being built up until finally, the aerodynamic body lands on the target.

The inaccuracy is also determined here by the angle beta; the angle beta primarily serves the purpose that not every tumbling motion of the aerodynamic body needs to be leveled out. On the other hand, it must be expected that for an angle beta of nearly 0, additional stabilization of the aerodynamic body is to be obtained, especially if the leveling takes place with transverse forces smaller than the maximum transverse forces, as is shown in the solution according to FIGS. 2 and 3; there, a forced rotation of the pair of wings 4 about the axis e—e (corresponding to increasing transverse-force generation) takes place if the brake disc 6 exerts a force via part 7 on the eccentrically arranged pin 8. The return of the pair of wings to the position "transverse force null" is accomplished by the spring 9 or aerodynamic effects at the wings. The sensor signal is fed via a slider 10 to a signal processor with amplification 11 and further to the brake coil 12.

Embodiments:

As already mentioned, the very simple system mentioned here can preferably be used for relatively slow targets for such purposes as:

free-fall rocket for defense against tanks and helicopters, ship targets, etc., i.e., attack from above;

steered guided bomb;

buoyant mines.

For faster targets or also faster aerodynamic bodies, increased reactivity of the search head/control system is required (i.e., ultimately faster switching times).

An improvement with respect to this field of application can be accomplished in two ways:

1. Use of low-inertia components,
2. Mechanical separation of the measuring system from the transverse-force generator.

Supplement to the Rotor/Rudder System I

In the case of extended coupling via the brake disc 6, the rudder pair rotates about the axis e—e up to a stop which can be realized, for instance, by the spring 9 firmly looped about part 7. Then, as a result, the pair of rudders together with the console will rotate about the axis x—x in the opposite direction of rotation if the aerodynamic body itself rotates relative to the environment; this means the possibility of generating a full command into a defined direction in space.

Description For FIG. 6

1. Use of Low-inertia Components for a Search Head

The surfaces of the transverse-force generator with the largest inertia can be replaced by a transverse-thrust nozzle according to DE-OS 33 17 583 which is supplied by ram air but preferably with gas by a hot-gas generator. Due to the reduced moment of inertia, the rotary drive of the blade wheel now requires only small dimensions or is itself replaced by a nozzle generating torques (rotating nozzle system).

In this case, the sensor is, for instance, a low-inertia laser receiver.

The command is given logically in accordance with FIGS. 1 to 4, i.e., when a command null is given, the rotating nozzle DD blows continuously into the inner wall I, for instance, of the shell FK. If a gate KL is braked by the braking system, the rotary unit slips axially, in this case backwards, in such a manner that more or less transverse force is generated outward depending on the intersection at the edge K, corresponding to the duration of the command given. (FIG. 6). The sensor S is designed as in FIGS. 4 and 5; the measurement signals are taken off by the slip ring 10. A neutral outlet 13 is further provided for the rotary nozzle.

2. Mechanical Separation of the Measuring System from the Transverse Force Generator The mechanical separation is to be understood so that the sensor system can rotate quickly independently of the transverse-force generator, i.e., it operates autonomously. This means that a more accurate command formation for the transverse-force generator can take place from the signals of the target and the rotation of the aerodynamic body relative to the sensor system in a computer.

ROTOR SETTING SYSTEM IV (no figure)

As a variant of the setting systems I to III according to FIGS. 1 to 4 with particularly low-inertia rotor:

If the aerodynamic body rotates about its longitudinal axis against the rotor and against the environment, a rudder pair fixed in space is realized in the extreme case when braking, with continous development of transverse force; first, the rudder (or pair of rudders) is deflected for the development of the transverse force; then, the pair of rudders is held in space by "excess pushing." An additional drive of the rotor may become necessary, depending on the setting system output required.

ROTOR-RUDDER V (no figure)

As a combination of the systems I to III and IV.

So that the advantages of Systems I to III and IV can be combined, a console with inertia and low inertia setting members are provided; if an extreme command is given (for instance, full braking), the rudder (pair) is rotated and for maximum detection, the console is decoupled from the setting members (pair of rudders); the console continues to run, advantageously aided by a separate rotary drive; the pair of rudders "remains standing" in space.

FIGS. 7 to 9: ROTOR RUDDER SYSTEM IX

This system should be viewed as similar to the rudder system II (see FIG. 2). FIGS. 7 to 9, in addition to the extending mechanism F and the brake E, show a special kind of generation of the transverse force:

Transverse-force NULL COMMAND: the rotor remains in rotation by the offset rudders (FIG. 9*a*); there is no transverse force and the rotation requires a minimum of power.

If a transverse-power force command is given, the tendency is produced to take back the rotor drive the more, the more the transverse force is to act into a direction in space until finally the rotor drive becomes 0 when both rudders are parallel to each other (FIG. 9*b*).

In the event of further or longer braking, the movable rudder continues to rotate; the transverse force becomes stronger once again, and in addition, a resetting roll torque is generated (FIG. 9*c*) whereby a fixation in space of a corresponding transverse force region becomes possible and specifically without rotation of the aerodynamic body.

Thus, this kind of control can be applied directly to roll-stabilized aerodynamic bodies.

Since only small moments of inertia can occur for fast control motions, other rotor rudder system solutions are conceivable only with the inertia mass decoupled (or, however, especially slow control actions are already sufficient for the mission of the aerodynamic body). In FIGS. 7 to 9, the extension system for the console A is designated with F; a sliding piston of the extension system F, acted upon by gas G from a gas generator is designated with 21; the braking system E is designed as in FIG. 1; a separate roll drive by tilted fixed wings 22 for the console is provided which can also be used for the spreading-wing solution according to FIG. 10; the fixed back rudder is designated with 23 and the forward rudder which is at the same time the setting member and the rotary drive for the motor is designated with 34.

The braking system according to FIG. 8 comprises a brake magnet 25 secured against rotation, with a brake disc 26, which acts on the control part C of the rotor.

FIG. 10

A variant of the transverse-force generation is shown in FIG. 10; in the case of a null command, the spreadable wings 33 and 34 disappear from the flow; in case of braking a transverse force of greater or smaller magnitude is generated, depending on the spreading of the wings via a -profile bar 35 which runs in a tubular enclosure 36 and is actuated by a magnet system or the like, not shown. The wings are offset relative to each other (angle gamma), so that also roll torque acts additionally with increasing transverse-force action; a roll torque which counteracts that generated continuously by the wing pair 33, 34. Thereby, the same effect can be obtained, namely, reversel of rotation as described above.

Further variants are realizable with an amplification effect, i.e., the rudders are actuated by the ram air; the control mechanism serves merely for controlling the ram air which actuates the rudders.

The Rotor Setting Systems According to FIGS. 11 to 14

In FIG. 11, a part of an aerodynamic body FK with the indicated longitudinal axis 41 of the aerodynamic body is shown. The forward part of the aerodynamic body is formed by the tip of the aerodynamic body with a target search head 42, the details of which are not shown specifically. The tip runs on ball bearings 43 about the aerodynamic body. In the tip of the aerodynamic body with the target search head, rudders 44 are shown, the rudder axis RA of which extends radially. Around the circumference of the target search head, at least two opposite rudders are shown, of which one (in this case the one shown) is adjustable. In the interior of the aerodynamic body, the rudder has a transmission pin 45 which is protruding away from the rudder axis and is associated with a transmission stop 46 of a brake disc 47. The brake disc forms the control unit for the rudder and cooperates with a ring magnet 48 on the side of the aerodynamic body. The parts 47 and 48 form a braking system as already explained above. It can be seen from FIG. 12 that by energizing the ring magnet, the brake disc stays back against the rotation of the search head or here, of a rotary part A located in the center of the aerodynamic body, so that the rudder is set opposite the longitudinal axis of the aerodynamic body. If the brake is released, then the brake disc corotates freely with the transmission pin again; the rudder is brought into the starting position by a return spring, not shown here.

In FIG. 13*a*, a system similar to that in FIG. 11 is shown. The same reference symbols are used, to which an (') is added. However, the rudder 44' is designed so that the pressure point 51 of the rudder is located in front of the radial rudder axis RA'. On the front side of the rudder, a further transmission pin 45'' is provided, with which a brake disc 47'' is associated. A further ring magnet 48'' cooperates with the brake disc. The operation of these parts 45'', 46'', 47'', 48'' is the same as that of the parts 45, 46, 47, 48. If the rudder is tilted, according to the description above, into the direction set in FIG. 13*b* by means of the ring magnet 48', the brake disc 47' and the transmission pin 45' shown in FIG. 13*b*, it remains in this offset position due to the location of the pressure point. The ring magnet can therefore be switched off again. If the rudder is to be brought into the starting position again, the ring magnet 48″ is actuated briefly, whereby the transmission stop of the washer 47″ grips the transmission pin 45″ and brings the rudder into the starting position. In this case, a return spring is accordingly not necessary. The rudder is switched into both positions by means of a simple pulse control. The power requirement is therefore very small. Also in these embodiments, rotary transmitters 49 are provided between the rotary part A or the search head, respectively, and the aerodynamic body, as is indicated in FIG. 13*a*.

In the simplest case, four rudders are provided, three of which generate a torque via the console with inertia. The fourth rudder is controlled in pulse-fashion. The rotary drive is accomplished by the rudders set at an angle; this, however, can also be accomplished by a motor.

In FIG. 14, a multiple-rudder rotor system is shown, in which several rudders with radial rudder axes are arranged on a rotary part A. Only one of the rudders is shown here; customarily, four or more rudders are used. All rudders can be adjusted about their rudder axes. Each rudder is set as in the embodiment, according to FIGS. 11 to 13 where here, the braking system of magnets and brake discs is resolved into several, in this case, eight cup magnets M1 to M8 and associated gates K1 to K4 with corresponding gate runners. These runners and the guiding gates are designed so that the rudder can be transferred from its rest position into the set position with the angle alpha and return therefrom again. The individual rudders are addressed so that the desired control component adjusts itself in a fixed space sector, i.e., a flowing control of all rudders is provided. The individual cup magnets are addressed similarly. With this embodiment, a full command can be achieved almost during the entire rotation of the aerodynamic body.

This multiple rudder system is similar to the rotor rudder system II. In principle, the power for deflecting the rudders is taken from the flow. By set rudders, not shown, the aerodynamic body FK (forward part, rear part), rotates in the direction of the arrow shown, the console A of the setting system by the four set rudders R1 to R4 (setting angle alpha, rudder axis 61) in the opposite direction. Each rudder has a runner K1 to K4 of magnetic material, each of which is guided in a guiding gate 62. The runners are preferably designed so that always two adjacent magnets M of eight cup magnets Ml to M8 release the rotary motion of the rudder if the two magnets are energized. The rudders are turned either aerodynamically or preferably by a spring, not shown. Likewise not shown is the support of the console A in the aerodynamic body. Depending on the moment of inertia of the aerodynamic body about the roll axis, a roll drive for the aerodynamic body can also be omitted.

The advantages of the system according to the invention: four-times faster readiness for generating a transverse force defined in space; as also with other solutions, a constant transverse-force command or the generation thereof is possible by letting the runners "slide."

The Rotor Setting System According to FIG. 15

In an aerodynamic-body tip FK, a bent console A is supported which comprises in the part which protrudes forward and is bent relative to the longitudinal axis of the aerodynamic body, two mutually offset rudders R. The control units for the bent console and the control units on the side of the aerodynamic body are not shown. This involves a braking system as in FIG. 1 and therefore a brake disc connected to the revolving console, and a braking magnet on the side of the aerodynamic body. If the braking system is not actuated, the bent console rotates freely at high velocity about the longitudinal axis of the aerodynamic body. If the bent console is stopped by the braking system, a transverse force according to a pitch torque acts on the aerodynamic body through the eccentric position of the rudders. The system shown in FIG. 15 can be used in conjunction with a search head system according to FIG. 5.

This rotor setting system (rotor rudder system VI) comprises the following parts on the rotor side:

console: bent low-inertia shaft;

rotary drive of the rotor; offset pair of rudders on the bent part of the console;

setting members: setting the pair of rudders opposite the longitudinal axis part of the aerodynamic body (always present);

control unit rotor: corresponds to the console plus braking magnet disc.

The control unit of the braking magnet is located on the side of the aerodynamic body.

Command null: constant high rotation of the rotor (sum of all transverse forces=0): the brake is disengaged or the brake is continuously switched on (continuous or pulse width modulation).

Command issue: reduced rotation when the desired transverse force direction is traversed by activating the brake or increased rotation in all transverse force directions not desired, for instance, also by other control means.

Notes: the aerodynamic body is braked.

The Rotor Setting System According to FIG. 16

In the tip of the aerodynamic body FK, a slim console A is supported whose axis of rotation is inclined relative to the longitudinal axis of the aerodynamic body. The console supports at its forward end which is located approximately on the longitudinal axis of the aerodynamic body, an offset pair of wings 71 so that the console is set in rapid rotation when the aerodynamic body is in flight. By the described arrangement, forces interfering with the aerodynamic body are practically avoided here. If a transverse force is to be exerted on the aerodynamic body in a certain direction, the console is stopped by a braking system E which consists of a magnet and a brake disc with teeth which meshes with a gear at the end of the console on the side of the aerodynamic body. The pair of wings, then stopped, exerts a transverse force on the aerodynamic body according to FIG. 16*b*, where the direction of this transverse force in space can be determined according to the held position of the console. With this sytem, a full command is possible only once during a revolution of the aerodynamic body if the latter rotates.

This rotor setting system (rotor rudder system VII) comprises the following on the rotor side:

a console: a low-inertia shaft arranged rotatably at an angle to the longitudinal axis of the aerodynamic body;

rotary drive of the rotor: offset pair of rudders on a shaft;

setting members: offset pair of rudders; control unit rotor: brake disc on the shaft. On the side of the aerodynamic body, a braking magnet is provided as the control unit.

Command null: the surface plane of the rudder pair points through the longitudinal axis of the aerodynamic body (the braking action on the aerodynamic body is small).

Command issue: surface plane of the rudder pair forms an angle with the longitudinal axis of the aerodynamic body. In the example, the command null is at 90°. The solution is simple.

The Rotor Setting System According to FIG. 17 (Rotor Rudder System VII)

The setting system proper with the console, the offset pair of wings and the magnetic system resembles the system shown in FIG. 16 so that a description can be dispensed with. This setting system in turn is contained in a rotary unit 81 which forms part of the aerodynamic body tip. This rotary unit is braced against the aerodynamic body housing FK. In the aerodynamic body housing, a ring magnet 82 is provided, with which a brake disc 83 is associated on the side of the rotary part. The ring magnet and the brake disc form a further braking system. The rotary part itself must be kept in rotation continuously by offset rudders R. Accordingly, these rudders serve only for the rotor drive. With this rotor system, a transverse force fixed in space can continuously be exerted on the aerodynamic body also if the latter is rotating.

In order to be able to generate continuously a transverse force in a direction in space, the entire tip (rotor) is coupled to the aerodynamic body by an additional control (braking magnet or also electric motor drive). Otherwise, this system is similar to that in FIG. 16. In the case of an electric motor drive, a tilting motion is possible.

In principle, the necessary rudder surface is generally reduced with increasing distance from the center of gravity of the aerodynamic body; thereby, the moment of inertia of the rudder is decreased and the switching process command/null command/command takes place more rapidly; the transverse force otherwise supplied by thrust nozzles can also become smaller, i.e., in many applications, a hot gas generator is not ecessary at all. If the holding rod, i.e., the console A is pushed out after leaving, for instance, the gun barrel, for instance, by the delay of the shell, the extended lever arm does not impede the manipulation of the aerodynamic body. It should be mentioned that also the holding rod itself generates buoyancy, which reduces the rudder surface additionally.

The Rotor Spoiler System According to FIG. 18

In a tip FK of the aerodynamic body, there is supported parallel to the longitudinal axis of the aerodynamic body a console A which is set in rotation by an offset pair of spoilers 91 at the tip. At the other end of the console, a gear 92 is provided which meshes with a brake disc 93 provided with teeth. Together with a magnet 94 this brake disc forms a braking system E, as described in connection with FIGS. 16 and 17.

In the event of a 100% (full) command, the offset pair of spoilers 91 is held in a plane parallel to the transverse plane of the aerodynamic body according to FIGS. 18*a* and 18*b;* in the event of a command null, the spoiler is held in the vertical plane of the aerodynamic body (FIGS. 18*c* and *d*).

The Rotor Spoiler System According to FIG. 19

In FIGS. 19*a* and 19*b*, a top view onto an aerodynamic body tip FK is shown, in which parts are broken away for the sake of greater clarity. A spoiler 101 desiged as a twisted sheet metal strip is mounted on a spoiler support 102 and is located, in the position shown in FIG. 19*a*, at the outside circumference of the aerodynamic body. Due to its shape, the spoiler causes the rotary drive of the entire console system A. To the spoiler support is connected a gear 103 which is designed as an armature and rotates about the same axis of rotation D. The armature meshes with a gear 104 which is connected to a braking magnet fixed to the aerodynamic body. The braking magnet poles 105 are likewise indicated. By appropriate rotation of the spoiler support and revolving of the individual gears on each other, the spoiler can be transferred on a desired curve in space from the position according to FIG. 19*a* into the position centered to the aerodynamic body according to FIG. 19*b*. This position corresponds to the null command and the position according to FIG. 19*a* corresponds to a full command.

In the foregoing specification, the invention has been described with reference to specific exemplary embodiments thereof. It will, however, be evident that various modifications and changes may be made thereunto without departing from the broader spirit and scope of the invention as set forth in the appended claims. The specifications and drawings are, accordingly, to be regarded in an illustrative rather than in a restrictive sense.

What is claimed is:

1. A rotor setting system for an aerodynamic body comprising:

rotor means comprising support means rotatably mounted on the aerodynamic body;

rotary drive means for driving said rotor means in rotation;

said rotary drive means comprising setting means for controlling the flight path of the aerodynamic body rotatably mounted on the support means;

first control means for controlling the rotation of the rotor means; and second control means coupled to said setting means for controlling the orientation of said setting means, said second control means being coupled to said first control means by said support means and cooperating with said first control means to set said setting means, said second control means being coupled to said setting means via a first shaft means, said shaft means having a cam means mounted thereon cooperating with a projection means coupled to said setting means for changing the orientation of a surface of said setting means with respect to a longitudinal axis of said aerodynamic body, and said setting means being mounted on a second shaft means disposed transversely to said rotor means and having said projection disposed thereon in abutment with said cam means, said rotor means further being coupled to said second control means via spring means coupled to said first shaft means for limiting movement between said second control means and said rotor means, whereby when said first control means determines a position of said rotor means with respect to said aerodynamic body, said second control means adjusts the orientation of said setting means thereby to determine the flight path of the aerodynamic body.

2. The rotor setting system recited in claim 1, wherein power for actuating the setting means is taken from the rotary drive means for the rotor means.

3. The rotor setting system recited in claim 1, wherein the rotary drive means for the rotor means comprises drive means arranged between the aerodynamic body and the rotor.

4. The rotor setting system recited in claim 3, wherein said drive means comprises one of an electric motor, a pneumatic system, a hydraulic system or a spring drive.

5. The rotor setting system recited in claim 1, further comprising angle-of-rotation transmitters provided between the rotor means and the aerodynamic body.

6. The rotor setting system recited in claim 1, wherein, at the tip of the aerodynamic body, a forward-protruding rotary unit means is provided which supports the setting means, and within the rotary unit the first control means cooperating with the second control means is provided for adjusting the setting means.

7. The rotor setting system recited in claim 6, wherein the setting means comprises at least two rudder means having a common axis of rotation.

8. The rotor setting system recited in claim 7, wherein at least one rudder means can be actuated independently of the other or both rudder means can be actuated independently of each other by the first control means.

9. The rotor setting system recited in claim 6, wherein the control means for actuating the setting means is spring-loaded in order to bring the setting means into the rest position if the first and second control means are not actuated.

* * * * *